US006471895B2

(12) United States Patent
Metten

(10) Patent No.: US 6,471,895 B2
(45) Date of Patent: Oct. 29, 2002

(54) METHOD FOR THE FABRICATION OF CONCRETE BLOCKS OR CONCRETE SLABS

(75) Inventor: Hans-Josef Metten, Bergisch-Gladbach (DE)

(73) Assignee: Metten-Stein + Design GmbH & Co., KG, Overath (DE)

( * ) Notice: Subject to any disclaimer, the term of this patent is extended or adjusted under 35 U.S.C. 154(b) by 0 days.

(21) Appl. No.: 09/904,292

(22) Filed: Jul. 12, 2001

(65) Prior Publication Data

US 2002/0053182 A1 May 9, 2002

(51) Int. Cl.[7] ..... E04F 21/24

(52) U.S. Cl. ..... 264/71; 52/745.19; 52/742.14; 52/749.1; 264/73; 264/245; 264/293; 264/162

(58) Field of Search ..... 52/745.19, 742.14; 264/71, 74, 162, 132

(56) References Cited

U.S. PATENT DOCUMENTS 3,936,209 A * 2/1976 Krage ..... 404/75
4,209,486 A * 6/1980 Ross ..... 264/245
4,271,111 A * 6/1981 Sheber ..... 264/71
4,935,083 A * 6/1990 Siler ..... 156/219
5,378,419 A * 1/1995 Capoccia ..... 264/162
5,637,236 A * 6/1997 Lowe ..... 216/39
5,638,656 A * 6/1997 Roe ..... 52/749.1
5,855,958 A * 1/1999 Nash ..... 427/274

FOREIGN PATENT DOCUMENTS

EP 0319972 12/1988

* cited by examiner

*Primary Examiner*—Carl D. Friedman
*Assistant Examiner*—Basil Katcheves
(74) *Attorney, Agent, or Firm*—Charles L. Schwab; Nexsen Pruet Jacobs & Pollard, LLC

(57) ABSTRACT

A method for the fabrication of concrete blocks (2) or concrete slabs of various forms and sizes, fabrication taking place on the basis of vibrational compaction in concrete-filled molds or dies, the block surface or slab surface of the concrete blocks or concrete slabs being subjected to at least one post-forming treatment and subsequent curing. The post-forming treatment includes gentle contact of the surfaces of the concrete blocks or concrete slabs with soft materials.

9 Claims, 1 Drawing Sheet

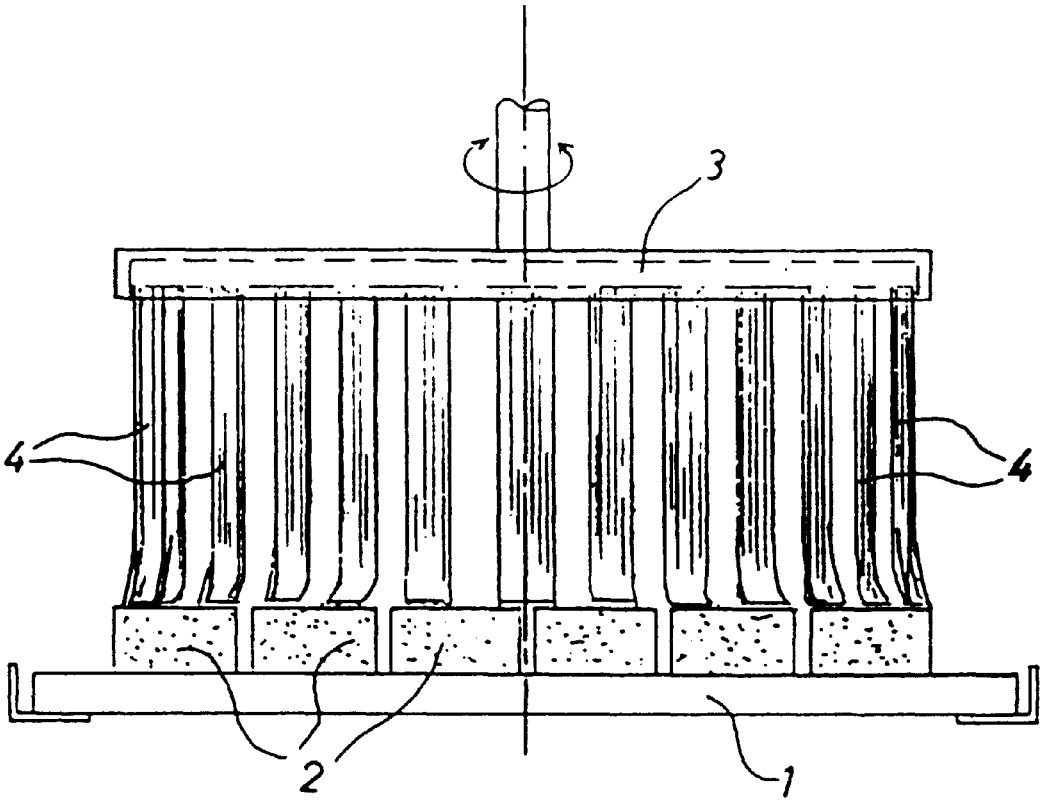
3
4
4
2
1

METHOD FOR THE FABRICATION OF CONCRETE BLOCKS OR CONCRETE SLABS

TECHNICAL FIELD

This invention relates to a method for the fabrication of concrete blocks or concrete slabs of various formats and sizes, fabrication taking place on the basis of vibrational compaction in concrete-filled molds and dies corresponding to the block or slab surface, the concrete blocks or concrete slabs being subjected to at least one post-forming treatment and subsequently curing.

BACKGROUND OF THE INVENTION

A method for the manufacturing and/or treatment of concrete blocks is disclosed in European patent document 0319972B1 issued Dec. 8, 1988 to Metten Produktions and Handels GmbH, in which the dies have projections or recesses by which the surface of the concrete blocks is roughened. The dies can, however, also be purposely kept smaller than the molds, resulting in marginal flashes, the removal of which likewise brings about a roughening of the rim of the concrete blocks. The roughening is further increased by virtue of the fact that the surfaces of the concrete blocks are treated with stiff brushes or with compressed air, water, or suitable blasting material, which issues from nozzles.

The concrete blocks manufactured according to this previous method have utility but have a rather rough surface, even the concrete grains adhering to the surface only through the binding action of the concrete.

OBJECTS AND SUMMARY OF THE INVENTION

It is an object of the present invention to provide a method by which a differently formed surface, a wider variety of colors and an enhanced reinforcement of the concrete grains on the surface is achieved. Furthermore, a surface is produced which is reduced in roughness relative to prior concrete block surfaces.

The object of the invention is achieved by virtue of the fact that, as a post-forming measure, the surfaces of the concrete blocks or concrete slabs are treated with soft materials. The soft materials and/or the concrete blocks or concrete slabs are preferably wet or wetted during the treatment operation. This "wobbling" treatment of the concrete blocks and concrete slabs in the not yet cured condition and, as appropriate, the presence of liquid during the operation, produces a surface that does experience some roughening but is such that no sharp-edged concrete graining arises.

Soft material stands are combined in one or a plurality of rows and/or fastened to surfaces or disks. They are guided over the surface of the concrete blocks or concrete slabs in arbitrary directions of motion, preferably in oscillatory or rotatory fashion, also as applicable with superimposition of a plurality of rotatory or oscillatory motions. The soft material is preferably made of natural or synthetic material such as cloths, sponges, nonwoven materials, felt, rubber or plastic, which can also be made in strip form and arranged in brush fashion or broom fashion in the rows and on the surfaces or disks.

Before the treatment of the surfaces, the soft material in the form of cloths, sponges and the like can be dipped into water, latexes, colors or color mixtures and then guided over the surfaces of the concrete blocks or concrete slabs, which are arranged on a production pallet. The latexes can also be latex paints, so that a surface coloration is effected in this way or with the colors or color mixtures, independently of the base color of the concrete blocks, which surface coloration experiences a color nuancing by virtue of the fact that the materials of the surfaces normally do not absorb the color uniformly.

Instead of the dipping of the soft substances, such as cloths and the like, however, water, latexes, colors or color mixtures can also be inlet onto the surfaces, preferably sprayed thereon, during the treatment.

An additional color effect can further be achieved by various tinting of the surfaces of the concrete blocks or concrete slabs and through the treatment of the whole production pallet with the soft substances and, as applicable, colors, the colors being distributed over a plurality of block surfaces or slab surfaces.

According to the invention it is also possible, as a further or an additional treatment measure, to apply latex, latex paint and/or colors and/or lacquers, as well as colorless lacquers, to the surfaces of the concrete blocks or concrete slabs before and/or after curing. A visual enhancement of the surface is achieved in this way, absorption of dirt is reduced, and the concrete grains are additionally immobilized. It has been found that the adhesion of dirt or dirt particles is also reduced. For example, chewing gum residues and the like do not adhere to the block surface. The colorfastness is also improved.

Furthermore, it is possible with this method to texture the surfaces of the concrete blocks or concrete slabs upon compaction and lifting of the dies by texturing of the dies, in particular with projections or recesses. The dies can also be purposely kept smaller than the molds so that a rim results. This as well as the roughening is equalized and made uniform by the subsequent "wobbling," so that a particular surface form is achieved.

The method of this invention yields a concrete block or a concrete slab whose surface is textured in a particular way and in which a variegated and/or lustrous surface is formed through special coloring and the concrete grains are immobilized.

BRIEF DESCRIPTION OF THE DRAWING

An essential step in the method is illustrated by the drawing, in which:

The single FIGURE shows a side view of a production pallet with concrete blocks and a rotatory disk arranged thereover.

DETAILED DESCRIPTION OF THE INVENTION

In the drawing, the reference numeral 1 identifies a production pallet, on which a large number of concrete blocks 2 are arranged. The blocks 2 were preferably made by vibrational compaction of concrete filled molds. A textured die with recesses and/or projections may be used to form the blocks 2, which results in a textured block surface. Mounted on a shaft above the concrete blocks 2 is a disk 3, which can, as shown by the arrows, be driven in either direction of rotation. The disk 3 can also be guided transversely to its rotational axis in various directions over the upper surfaces of the concrete blocks 2. Attached to the disk 3 are strips of soft material 4, the ends of which graze the surfaces of the concrete blocks 2. The soft material (4) is pliable and may be natural or synthetic material such as woven and non-woven cloth or fabric, rubber, sponge, felt or plastic.

Because material strips 4 are wet while grazing the surfaces of the concrete blocks, a particular surface texture of the concrete blocks is achieved. The surface treatment may be enhanced by tinting the top layer of the concrete blocks, if appropriate, by tinting in various colors distributed over the pallet. This post-forming treatment of the surfaces of the concrete blocks is preferably carried out when the concrete blocks are still wet or moist. As hereinbefore explained, the treatment can be carried out by adding latex, paint or tint to the surfaces of the concrete blocks prior to or during the post-forming treatment with the soft material strips (4). Also the soft material strips (4) may be dipped in latex, paint or a tinting liquid prior to post-forming engagement with the block surface.

What is claimed is:

1. A method for the fabrication of concrete blocks (2) or concrete slabs of various forms and sizes, comprising the steps of:

forming concrete blocks (2) by filling molds with concrete, vibrationally compacting said concrete and removing said blocks (2) from said molds in a manner exposing upper surfaces that are wet, dipping soft material (4) in a latex, subjecting said upper surfaces of said blocks (2) to a post-forming treatment by moving contact of said dipped soft material (4) against said upper surfaces of said blocks and curing said blocks.

2. The method of claim 1 wherein said soft material (4) is rotated during said post-forming treatment.

3. A method for the fabrication of concrete blocks (2) or concrete slabs of various forms and sizes, comprising the steps of:

forming concrete blocks (2) by filling molds with concrete, vibrationally compacting said concrete and removing said blocks (2) from said molds in a manner exposing upper surfaces that are wet, dipping soft material (4) in a paint, subjecting said upper surfaces of said blocks (2) to a post-forming treatment by moving contact of said dipped soft material (4) against said upper surfaces of said blocks and curing said blocks.

4. The method of claim 3 wherein said soft material (4) is rotated during said post-forming treatment.

5. The method of claim 3 wherein said post-forming treatment produces variegated upper surfaces.

6. A method of the fabrication of concrete blocks (2) or concrete slabs of various forms of sizes, comprising the steps of:

forming concrete blocks (2) by filling molds with concrete, vibrationally compacting said concrete and removing said blocks (2) from said molds in a manner exposing upper surfaces that are wet, subjecting said upper surfaces of said blocks (2) to a post-forming treatment by moving contact of soft material (4) against said upper surfaces of said blocks, applying paint to said upper surfaces and curing said blocks.

7. A method for the fabrication of a concrete block (2), comprising the steps of:

forming a concrete block (2) with suitable forming equipment, removing said block (2) from said forming equipment to expose an upper uncured surface, subjecting said upper surface to a post-forming treatment by moving contact of said upper surface with soft material (4) and by simultaneously applying a tinting liquid to said upper surface and curing said block (2).

8. A method for the fabrication of a concrete block (2), comprising the steps of:

forming a concrete block (2) with suitable forming equipment, removing said block (2) from said forming equipment to expose an upper uncured surface, applying a tinting liquid to said upper surface of said block (2), subjecting said upper surface to a post-forming treatment by moving contact of said upper surface with soft material (4) and curing said block (2).

9. A method for the fabrication of concrete blocks (2) or concrete slabs of various forms and sizes, comprising the steps of:

forming concrete blocks (2) by filling molds with concrete, vibrationally compacting said concrete and removing said blocks (2) from said molds in a manner exposing upper surfaces that are wet, subjecting said upper surfaces of said blocks (2) to a post-forming treatment by rotating a disk (3) from which strands of soft material (4) are suspended, said strands of soft material (4) contacting said upper surfaces of said blocks during rotation of said disk (3) and curing said blocks.

* * * * *